US005131187A

United States Patent [19]

Agnew et al.

[11] Patent Number: 5,131,187

[45] Date of Patent: Jul. 21, 1992

[54] GATE ASSEMBLY

[75] Inventors: Colvin H. Agnew; Weldon O. Wade, both of Alamogordo; Stuart H. Agnew, Albuquerque; Chris Johnson, Alamogordo, all of N. Mex.

[73] Assignee: W & A Enterprises, Alamogordo, N. Mex.

[21] Appl. No.: 643,583

[22] Filed: Jan. 22, 1991

Related U.S. Application Data

[63] Continuation-in-part of Ser. No. 1,847, Jan. 9, 1987, Pat. No. 4,986,031.

[51] Int. Cl.[5] ..... E05D 7/00

[52] U.S. Cl. ..... 49/385; 49/386; 49/340

[58] Field of Search ..... 49/385, 386, 445, 331, 49/347; 16/72, 85, 78

[56] References Cited

U.S. PATENT DOCUMENTS 4,270,312 6/1981 Courtis et al. ..... 49/385

4,887,393 12/1989 Cysewski ..... 49/486

*Primary Examiner*—Gerald A. Anderson

*Attorney, Agent, or Firm*—Lane, Aitken & McCann

[57] ABSTRACT

A gate assembly for a vertically pivoting gate includes a support and coil springs connected between the gate and the support to bias the gate toward a vertical, open position, as well as from the open position back to a horizontal, closed position. The springs are attached to the support, and cables extend from the springs to the gate. Sheaves mounted on the support engage the cables to induce the return bias in the springs to move the gate back to the closed position. The mounting for the sheaves includes a member engaging the gate to support the gate in a precisely vertical orientation when the gate is in the open position.

21 Claims, 4 Drawing Sheets

GATE ASSEMBLY

CROSS REFERENCE TO RELATED APPLICATION

This is a continuation-in-part of Ser. No. 001,847, filed on Jan. 9, 1987, now U.S. Pat. No. 4,986,031.

BACKGROUND OF THE INVENTION

This invention relates to a power driven gate assembly for a vertically pivoting gate.

Generally, openings in enclosed areas have gates for controlling ingress and egress via walkways and roadways. The most common gate style is the swinging gate, but, although swinging gates are satisfactory for walkways, their use becomes more cumbersome as they increase in size, such as for roadways. Conventional roadway gates have a number of drawbacks. For example, the weight of roadway gates presents a problem in the provision of adequate hinges and may make the gate difficult to operate. In an attempt to solve these problems, pairs of gates meeting at the center sometimes are utilized.

Another problem with roadway gates is the need for getting out of a vehicle to open the gate, driving the vehicle through, and getting out of the vehicle again to close the gate. For this reason, other proposals for power operated roadway gates have been made, including gate assemblies having overhead frameworks into which the gates are raised. Such gate assemblies of necessity have limited overhead clearance and are unsightly because of the overhead structural elements.

Many of the drawbacks of the gate assemblies just discussed are overcome by power operated gates which pivot so that they stand vertically on end when opened. One such gate, which is the subject of U.S. Pat. No. 3,839,826, utilizes a combination of a tension spring and a torsion spring to assist the power drive mechanism, whereby the tension spring urges the gate from the closed position toward the open position and the torsion spring acts in the opposite direction.

Although this vertically pivoting power driven gate construction offers advantages over swinging gates, particularly in snowy climates, it has certain shortcomings. The drive motor has to be of considerable size because of its location adjacent the pivot point of the gate. Also, the use of the combination of the torsion spring and the tension spring makes the design somewhat complicated and increases its cost. These shortcomings were avoided in the gate assembly disclosed in U.S. Pat. No. 4,470,221, which can be operated with a conventional power source, such as a common garage door opening unit, and can be operated manually if desired using only a minimum of effort. Furthermore, the gate assembly of U.S. Pat. No. 4,470,221 employs an arcuate fulcrum for each tension spring in order to tension the springs as the gate approaches its open position and thereby eliminate the need for a separate spring to perform that function. However, this arrangement tends to place a large torque on the ends of the springs. In addition, known vertically pivoting gates rely on switches in the drive motors to stop the gate in its closed and open positions. These switches, which are usually in the form of knurled knobs, may and do travel from their initial settings, thereby allowing the barrier to open or close beyond its intended limit. As a result, the movement of the gate can be limited by structural members of the gate assembly before the switches shut off current to the motor. Therefore, the motors can overload and burn out.

When the gate pivots past vertical, a component of the weight of the gate acts against the start of the pivoting movement of the gate back toward the closed position and thereby increases the load on the motor. Since the issuance of U.S. Pat. No. 4,470,221, there has been an increased demand for gate assemblies to close even wider openings in enclosures, thereby calling for even longer and heavier gates or barriers. Such great lengths tend to place an excessive load on the pivot shafts and brackets of vertical pivoting the assemblies and to render the gates unstable as they move between their horizonal, closed positions and their vertical, open positions. The increased weight of the longer gates renders the spring arrangements of the previous gate assemblies marginal or totally inadequate in assisting the motor drives.

In the parent application, Ser. No. 001,847, a spring mounting arrangement allows the tension of the motor-assisting springs to be adjusted more easily and additional springs to be mounted for greater motor assistance. Furthermore, a stop member provided in a gate support frame not only supports the gate at precisely 90° to the horizontal when the gate is in the open position, but also places all of the springs in tension as the gate approaches its open position in order to help the motor start moving the gate when closing of the gate is desired. Moreover, the stop member tensions the springs without the need for arcuate fulcrums and avoids the large torsional forces which are induced in the ends of the springs in arrangements using arcuate fulcrums. In addition, stabilizer members extend laterally from the support frame, and ball bearings in pillow blocks are provided for receiving the pivot shaft to accommodate the greater bearing forces generated by longer and heavier gates.

Although the gates disclosed in the parent application have performed well, there has been some concern that the metal of the motor-assisting springs might fatigue after a very high number of cycles of opening and closing of the gate due to the fact that the springs directly contact the stop member, bend laterally about the stop member, and slide on the stop member as the gate opens.

SUMMARY OF THE INVENTION

By the present invention, an assembly for a vertically pivoting gate has motor-assisting springs which do not engage the stop member. Instead, the springs are shortened relative to the known motor-assisting springs, and an elongate element capable of transmitting substantial forces in tension and having a higher resistance than a coil spring to failure from cyclical lateral bending, such as a steel cable, connects the springs to the gate, whereby a motor-assisting bias is maintained, but the stop member engages and deflects the cables rather than the spring. The stop member includes a bend distributing member having a substantial surface engageable with the elongate element to distribute the lateral bending of the elongate element over a significant length of the elongate element, thereby reducing the amount of lateral bending induced at any point along the elongate element. The bend distributing member is mounted for movement with the elongate element in a direction parallel to the length of the portion of the elongate element which the bend distributing member contacts when the bend distributing member is in engagement with the elongate element. As a result, any abrasion in the elongate element as the elongate element moves in connection with the opening and closing of the gate is avoided. In a preferred embodiment, the bend distributing member comprises a sheave mounted for rotation on the stop member to avoid abrasion of the cable against the stop member and to induce bending the cable over an arc having a significant radius rather than about a relatively narrow edge.

These and other benefits and advantages of the gate assembly of the present invention will be apparent from the following description and the accompanying drawings.

DETAILED DESCRIPTION OF THE PREFERRED EMBODIMENT

Figure 1:
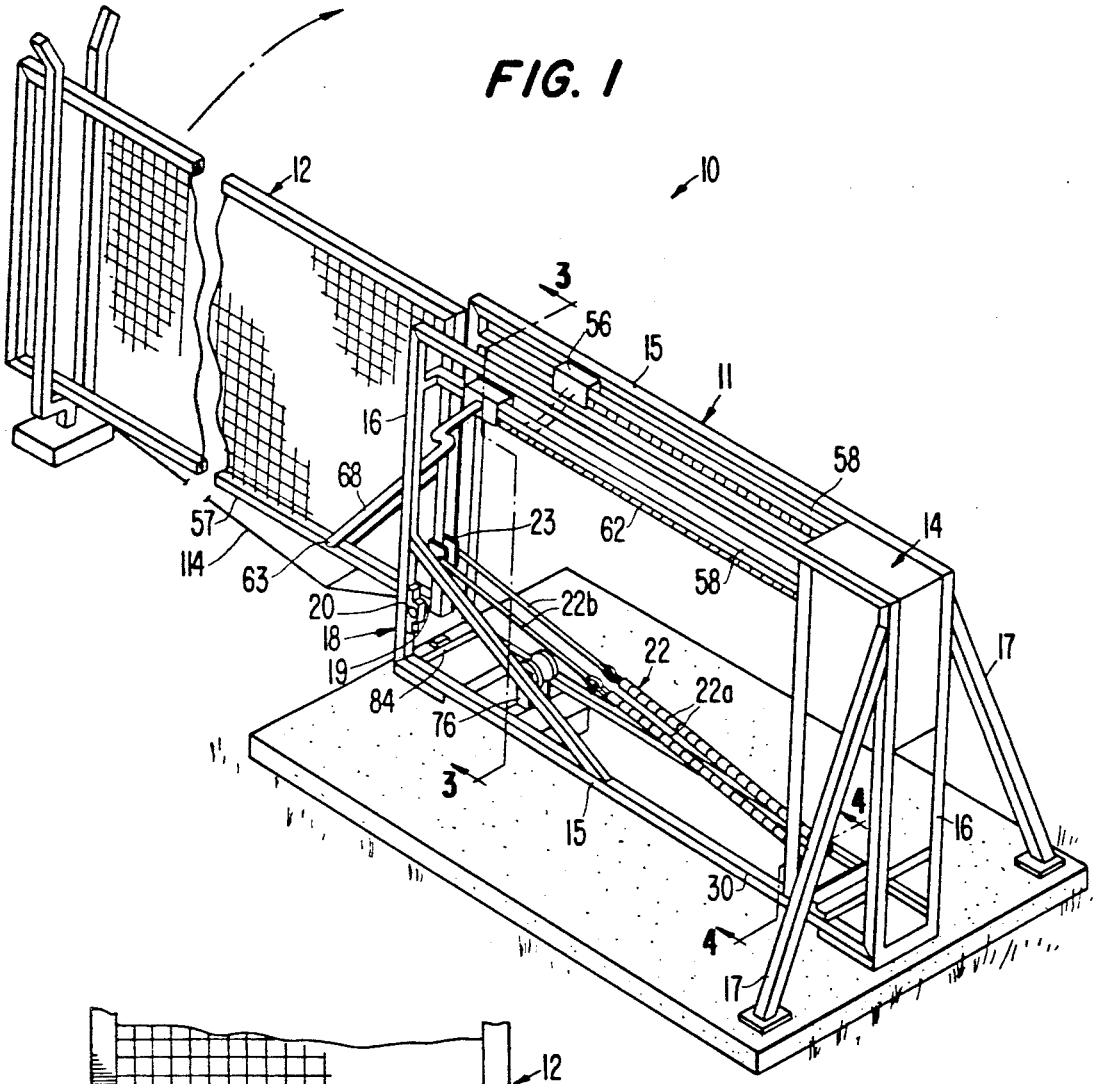
FIG. 1 is a view in perspective of form of the gate assembly of the invention in a closed position.
Figure 2:
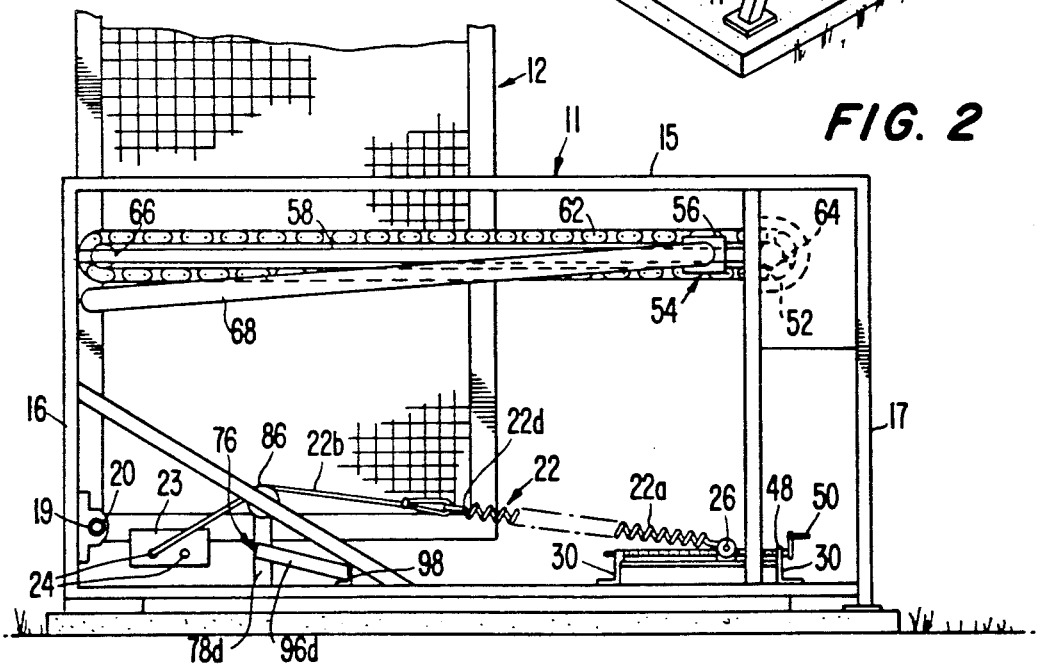
FIG. 2 is an enlarged fragmentary side view of the gate assembly shown in FIG. 1 in an open position.

As is best shown in FIGS. 1 and 2, one form of the gate assembly of the invention, which is designated generally by the reference numeral 10, includes a support frame 11 and a gate 12 carried by the support. The gate 12 is movable with respect to the support frame 11. A gate activating portion is mounted on generally horizonal members 15 and generally vertical members 16 of the support frame 11. Advantageously, the generally horizontal and vertical frame members 15 and 16 are disposed on opposite sides of the plane of the gate. The gate 12 has one end disposed adjacent to the support frame 11 with the gate 12 extending outwardly therefrom. Brace members 17 preferably extend laterally at an angle from an upper portion of the support frame to a plate embedded in a concrete base to provide the gate assembly 10 with lateral stability. Although the brace members 17 are shown at only one end of the support frame 11 for clarity of illustration, it is understood that they normally will also be provided at the opposite end. The lower part of the gate end adjacent to the support frame 11 is connected thereto through a pivot connection 18.

The pivot connection 18 includes a rotatable shaft 19 received in rolling-element bearings 20, such as sealed ball bearings of the pillow block type, which are well suited for attachment to the vertical frame members 16. Between the bearings 20, the rotatable shaft 19 is connected to the gate 12 by, for example, plates welded to a member of the gate 12 adjacent to the pivot axis, the plates having apertures or other configuration to receive the rotatable shaft 19 and to fix the shaft to the gate.

Figure 6:
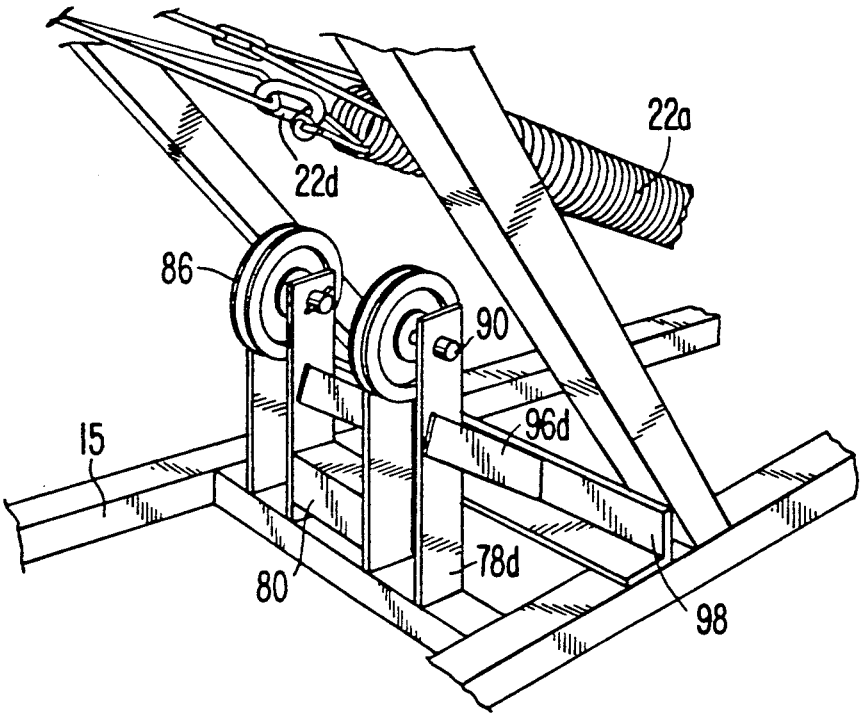
FIG. 6 is an enlarged front view of the stop member of the gate assembly of FIG. 1.
Figure 7:
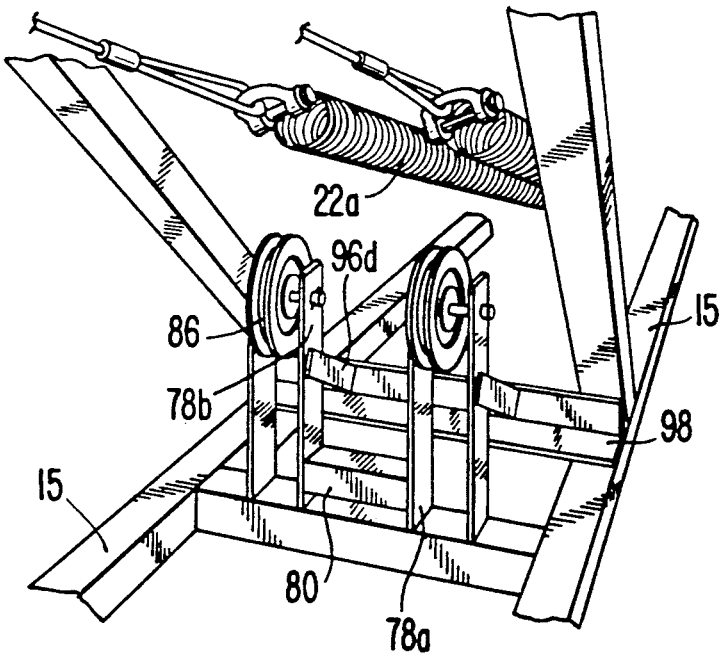
FIG. 7 is a side view of the stop member of FIG. 1.

A biasing device, that is, a generally linear tension device such as at least one coil spring assembly 22, and preferably two or more coil spring assemblies 22 spaced from each other a sufficient distance that the gate 12 may pass therebetween in its movement from a closed position to an open position, assists a drive mechanism, to be described hereinafter, to move the gate 12. Each coil spring assembly 22 includes a coil spring **22*a* and a high tensile strength flexible member, such as a steel cable 22*b*, wherein an end of the steel cable 22*b* is connected to an end of the coil spring 22*a* by a steel hook 22*c* (FIG. 6) of generally U-shape having ends wrapped around the end convolution of the coil spring 22*b*. The hook 22*c* is connected to the steel cable 22*b* by means of a clevis 22*d* having a pin passing through the "U" defined by the steel hook 22*c*. An end of the cable 22*b* extends through a "U" defined by the clevis and forms a loop at the end of the cable 22*b***, the free end of the loop being secured to the other end by conventional means.

The opposite end of each cable **22*b* is attached to the end of the gate 12 adjacent to the pivot axis, that is, the end of the gate 12 closest to the vertical frame members 16 of the support frame 11. The opposite or lower end of each spring 22*a* is affixed to an adjustable slide connector to be described hereinafter. Preferably, the lower end of the spring 22*a*** includes a separate hook which is secured to the last turn or last several turns of the spring and which reduces the bending forces present in hook portions unitary with the springs.

Figure 3:
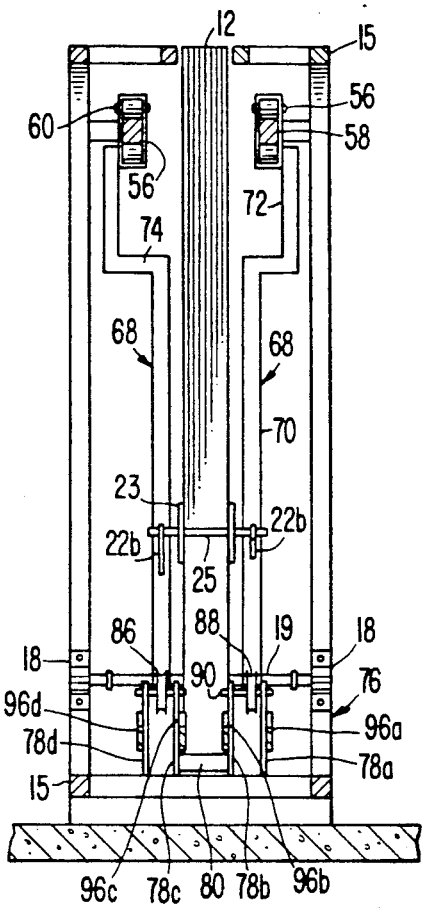
FIG. 3 is a sectional view of the gate assembly shown in FIG. 1 taken along line 3—3 thereof.

For attaching the upper ends of the cables **22*b*, as can be seen from FIGS. 1-3, a pair of plates 23 is secured to the gate 12, extending toward the support frame 11. A plurality of apertures 24 is defined in each plate 23, each aperture 24 being in alignment with a corresponding aperture 24 in the outer plate 23 so that a pin can be received in any or all of the pairs of apertures 24 to anchor the cables 22*b*. Pins of varying length can be used, and longer pins can accommodate two pairs of cables 22*b***.

Figure 4:
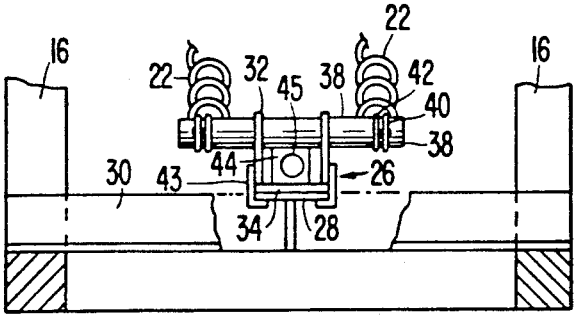
FIG. 4 is a partial sectional view of the gate assembly take along line 4—4 of FIG. 1.
Figure 5:
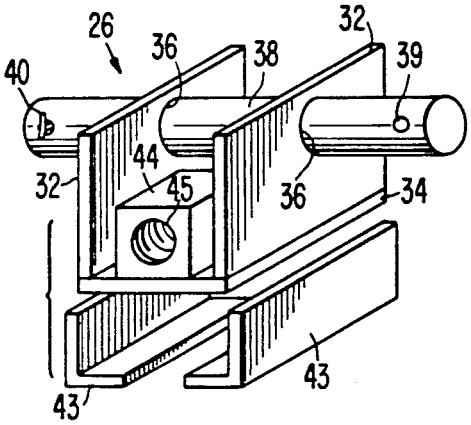
FIG. 5 is an enlarged perspective view of an adjustable slide connector used in connection with tensioning springs in the gate assembly of FIG. 1.

As can be seen from FIG. 2, an adjustable slide connector 26 is mounted on a slide rail 28 extending between two cross members 30 secured between the lower horizontal members 15 of the frame 11. As can best be seen from FIGS. 4 and 5, a pair of upstanding plates 32 on the slide connector 26 extend up from a base plate 34 resting on the slide rail 28 and define aligned openings 36 for accepting an anchoring pin 38 having projecting ends to which the lower ends of the springs **22*a* are attached. Transverse bores 39 are defined near the ends of anchoring pin 38 to receive cotter pins 40 for retaining the hooks 42 of the springs 22*a* Washers are normally employed in connection with the cotter pins 40**.

A pair of angle members 43 is secured to the upstanding plates 32 extend under the slide rail 28 to capture the slide rail between the base plate 34 and the angle members 43. An element 44 having a threaded bore 45 is affixed to the base plate 34 to receive a mating screw element 46, which is journaled in journal members 48 mounted on the cross members 30. By rotation of the screw element 46, the slide connector 26 is made to move along the slide rail 38 and, thereby, adjust the tension in the springs 22. A crank 50, which may be detachable, is provided to turn the screw element 46 by connection to, for ex ample, a hexagonal head on an end of the screw element 46 projecting past one of the journal members 48. The adjustable slide connector 26 changes the initial length and thereby the tension in the springs 22b.

The gate activating portion 14 provides movement of the gate 12 from the down or closed position, as shown in FIG. 1, to the open or raised position, as shown in FIG. 2, and back. The gate activating portion 14 advantageously is mounted on, and preferably within, the support frame 11. The gate activating portion 14 includes a power source which advantageously includes an electric motor 52 and a drive mechanism 54 operatively connected to the electric motor. The drive mechanism 54 includes a pair of transversely spaced roller assemblies 56 each carried on a horizontal rail member of the support frame 11 for movement in a substantially horizontal plane, as can be seen from FIG. 3. The rail members 58 extend from adjacent the electric motor 52 to the opposite end of the support frame in an upper portion thereof. The rail members 58 are disposed substantially parallel to the horizontal frame members 15 and are sufficiently spaced from each other to accommodate the gate 12 therebetween.

Each of the roller assemblies 56 includes a plurality of rollers 60 in contact with the rail members 58, preferably with some of the rollers 60 engaging the top of their rail member 58, and some of the rollers 60 engaging the bottom of the rail member. A continuous flexible drive loop 62, such as a drive chain, is connected to each roller assembly 56 and is adjacent the ends of each rail member 58 on sprockets 64 and 66. The sprockets 64 are operatively connected to the electric motor 52 to be rotated thereby in both directions. Arm members 68 extend from the roller assemblies 56 to opposite sides of the gate 12. Each arm member 68 has one end 55 pivotally connected to the roller assembly 56 disposed on the same side of the gate 12 as the arm member.

The opposite end of each arm member 68 is pivotally connected to the gate 12 adjacent the lower edge 57 of the gate (FIG. 1). The point of pivotal connection is spaced from the rotatable shaft 19, which defines the pivot axis of the gate 12. The pivotal connections of the lower ends of the arm member 68 to the gate 12 advantageously are achieved through a common pin 63 extending through the arm ends and the gate 12. As can be seen from FIG. 3, each of the arm members 68 preferably includes a main longitudinal section 70 that extends closely adjacent the gate 12 and a secondary longitudinal section 72 adjacent the respective roller assembly 56. The secondary longitudinal section 72 is offset from the main longitudinal section 70 and connected therewith by a short transverse section 74. As an alternative to the two arm members 68, a single arm member of heavier construction can be used on one side of the gate 12, and a cross member can be used to connect the two roller assemblies 56 to one another.

A stop member 76 is secured across the lower horizontal members 15 of the support 11 to prevent the gate 12 from pivoting beyond a 90° angle with respect to the horizontal when the gate moves into its open position, as shown in FIG. 2. Although a control system for the electric motor 52 includes switches for stopping the motor when the gate 12 is opened and closed, such a system may not be precise enough to prevent the gate from going past the vertical when it moves into its open position. The stop member 76 includes a plurality of upright members 78a–78d, each secured to one of the lower horizontal members 15 of the support frame 11 positioned between the rotatable shaft 19 and the adjustable slide connector 26. A cross member 80 is affixed to two central upright members 78b and 78c, just slightly above the horizontal member 15 in the illustrated embodiment, so that the cross member 80 engages the end of the gate 12 adjacent to the rotatable shaft 19 when the gate attains a precisely vertical position. Thus, the cross member 80 is positioned such that its upper surface is at a level above the bottom horizontal frame members 15 equal to the level of the pivot axis defined by the rotatable shaft 19 minus the distance from the pivot axis to the adjacent end of the gate 12. A limit switch (not shown) is mounted, for example, in the motor housing of the gate activating portion 14 to shut off power to the electric motor 52 when the gate 12 reaches its vertical position. Another limit switch can be mounted, for example, on a cross member of the support frame 11 near the pivot axis, to shut off power to the electric motor 52 when the gate 12 reaches its horizontal position. The stop member 76 also includes structure for engaging and upwardly deflecting the cables 22b and thereby inducing tension in the springs 22a. This structure comprises bend distributing members, such as sheaves 86, which are mounted for movement with the spring assemblies 22 in a direction parallel to the length of the portion of the spring assemblies 22 that the bend distributing members 86 engage, when the bend distributing members 86 contact the spring assemblies 22. The sheaves 86 have curved surfaces which engage the cables 22b over a significant portion of the length of the cables to distribute bending along the cables as the cables are deflected laterally by the engagement members. In the illustrated embodiment, the sheaves 86 are mounted for free rotation between a first pair, 78a and 78b, and a second pair, 78c and 78d, of the upright members so that the sheaves 86 move with the cables 22b when the sheaves 86 are in engagement with the cables 22b, and thereby avoid any abrasion which might result from sliding of the cables on the sheaves. The sheaves 86 are positioned such that a groove 88 defined by each sheave 86 is in vertical alignment with one of the cables 22b. Each sheave 86 is mounted on a pin 90 extending through aligned apertures in the upright members 78a–78d, the pins being retained in the apertures by cotter pins. The upright members 78a–78e are braced by brace members 96a–96d, extending respectively from an area of each upright member spaced above the horizontal member 15 of the support frame 11 at an oblique angle to an angle member 98 extending across the support frame 11 from one horizontal frame member 15 to an opposite horizontal frame member 15. The upright members 78a–78d, the cross member 80, the brace members 96a–96d and the angle member 98 can all be secured to the frame 11 and to one another by welding.

The height of the groove 88 of each sheave 86 above the bottom horizontal frame members 15 is greater than the corresponding height of a straight line between the anchoring point of the cable 22b on the gate 12 and the anchoring pin 38 on the adjustable slide member 26 when the gate is in the open position, so that the sheaves 86 of the stop member 76 deflect the cables 22b upward and thereby induce tension in the springs 22a. As a result, the spring assemblies 22 assist the electric motor 52 in beginning the movement of the gate 12 from its vertical, open position to its horizontal, closed position. The use of the sheaves 86, for example, sheaves having a 5 inch diameter, causes the bending in the cables 22b to be distributed over a portion of the length of the cable rather than being concentrated at a single point along the length.

In an alternate embodiment, not shown, horizontal tubular members can be used in place of the sheaves 86, the tubular members being welded between the upright members 70*a* and 70*b* comprising the first pair and the upright members 78*c* and 78*d* comprising the second pair, at the appropriate height for inducing the necessary bias in the spring assemblies 22.

Figure 8:
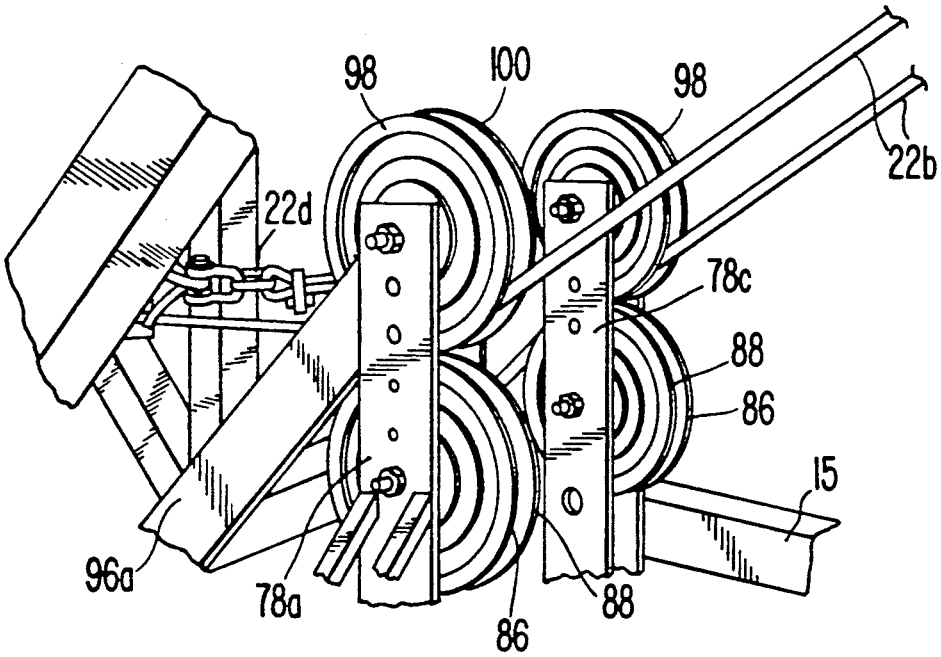
FIG. 8 is a perspective view of an alternative sheave arrangement on the stop member of FIG. 1.

As can be seen from FIG. 8, an additional pair of sheaves 98 can be mounted on the uprights 78*a*–78*d* close above and in vertical alignment with the sheaves 86. The sheaves 98 define grooves 100, and the spacing between the sheaves 86 and the sheaves 98 is less than the thickness of one of the cables 22*b*, so that each cable 22*b* is captured within the grooves 88 and 100 and between the sheaves 86 and 98. This arrangement assures that the cables 22*b* seat in the grooves 88 as the gate 12 moves from the closed position to the open position and the cables 22*b* accordingly descend. When the gate 12 again opens, the cables 22*b* are prevented from moving out of vertical alignment with the grooves 88, since the cables are captured between the sheaves 88 and 98. As the gate 12 closes, the springs 22*a* expand and the cables 22*b* move parallel to the length of the spring assemblies 22, while the cables rise. Consequently, the cables 22*b* engage the sheaves 98 and cause them to revolve about their axes.

In the operation and use of the gate assembly 10 of the present invention as shown in the drawings, the gate activating portion 14 may be actuated by, for example, a radio transmitter and receiver (not shown) of a garage door opener. This starts the operation of the electric motor 52 and the rotation of sprockets 64 and, consequently, movement of the drive loops 62 to advance the roller assemblies 56 attached thereto. Movement of the roller assemblies 56 causes the arm members 68 pivotally connected thereto to be drawn into the support frame 11. Since the arm members 68 are pivotally connected at their lower ends to the lower edge of the gate 12, the end of the gate adjacent the support frame 11 is rotated about the rotatable shaft 19. As one end of the gate 12 moves pivotally into the support frame 11, the cables 22*b*, which are affixed to the gate 12, move below the level of the grooves 88 at the top of the sheaves 86, causing the sheaves to deflect the cables 22*b* upward and to induce tension in the springs 22*a*. The upward movement of the gate 12 continues until the gate has pivoted to a vertical position at precisely a right angle to its original horizontal position, at which point the end of the gate 12 adjacent to the rotatable shaft 19 contacts the cross member 80 and is supported thereby.

To close the gate 12, the radio transmitter may be actuated again to reverse the electric motor 52 and the direction of travel of the drive loops 62, the roller assemblies 56 and the arm members 68. The tension in the springs 22*a* helps start the gate 12 moving toward its closed position and reduces the load on the electric motor 52.

Operation of the gate assembly 10 of the invention also can be effected through the use of electrical switches (not shown) located adjacent the gate assembly rather than with a radio transmitter. In addition, if there should be a power failure, the gate assembly can be operated manually. Manual operation may be achieved conveniently by releasing a clutch (not shown) on the electric motor 52 or by disconnecting the arm members 68 from the gate 12 and/or from roller assemblies 56 and simply lifting the free end of the gate 12. Since the spring assemblies 22 in combination with the stop member 76 provides an effective counterbalancing of the movement of the gate, the gate can be moved manually in either direction with a minimum of effort.

Figure 9:
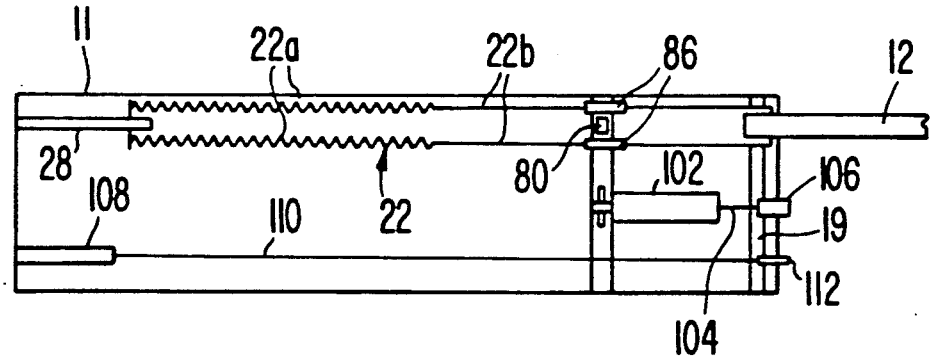
FIG. 9 is a schematic illustration of an alternate embodiment of the gate assembly according to the present invention employing a hydraulic cylinder.

Drive arrangements other than the drive mechanism 54 can be employed with the gate in accordance with the present invention. For example, as can be seen in the schematic illustration of FIG. 9, a hydraulic cylinder 102 can be used to move the gate 12 between its closed and open positions. In this arrangement, one end of the hydraulic cylinder 102 is pivotally secured to a horizontal transverse member of the frame 11 and a rod 104 extending from the piston of the hydraulic cylinder 102 is pivotally connected to a ram arm 106 secured to the rotatable shaft 19. The hydraulic cylinder 102 is positioned substantially along the longitudinal center line of the frame 11. Accordingly, the stop member 76, including the sheaves 86 and the cross member 80, and the gate 12 are shifted to one side or the other of the longitudinal center line of the frame 11, in accordance with the requirements of the particular gate application. Limit switches are contained in a housing 108 mounted at the end of the frame 11 distal to the pivot shaft 19 and are actuated by a connecting rod 110 extending between the housing 108 and an arm 112 connected to the pivot shaft 19. The spring assemblies 22 and the adjustable slide connector 26 are also positioned to one side or the other of the longitudinal axis of the frame 11 and in alignment with the stop member 76 and the gate 12.

It will be apparent that various modifications within the scope of the invention can be made in the particular embodiment of the gate assembly described in detail above and shown in the drawings. For example, anti-sway cables 114 (FIG. 1) can be secured across the gate 12 to stiffen it and provide it with greater stability, and spreaders can be positioned between the gate 12 and the anti-sway cables 114 intermediate the ends of the cables. As an alternative to the anti-sway cables 114, a truss having approximately the same outline as one of the cables 114 can be secured to the gate 12 on one side of the gate, in the same position as one of the cables. When a truss is used on one side of the gate, no cable or truss is needed on the other side. As another example, guide members such as shims can be secured to the upper horizontal frame members 15 of the support frame 11 to guide the gate 12 as it moves between its open and closed positions. In addition, the size, configuration and arrangement of the components can be changed to meet specific requirements. Also, a variety of structural materials may be utilized in the fabrication of the gate assembly as desired. Therefore, the scope of the invention is to be limited only by the following claims.

We claim:

1. A gate assembly comprising:

a gate;

a support for said gate, said gate being movable relative to said support between a closed position, in which said gate is generally horizontal, and an open position, in which said gate is generally vertical;

means for biasing said gate toward the open position, said biasing means exerting a force on said gate insufficient to independently move said gate to the open position, said biasing means comprising at least one generally linear tension spring and an elongate element connected to said spring; and means for inducing a return bias in said biasing means when said gate is near the open position, said elongate element engaging said return bias inducing means when said gate is near the open position, said return bias inducing means also comprising means for contacting said gate to support said gate in a precisely vertical orientation when said gate is in the open position.

2. The gate assembly of claim 1, wherein said spring has a first end attached to said support and a second end attached to said elongate element, and said elongate element has a first end attached to said spring and a second end attached to said gate.

3. The gate assembly of claim 1, wherein said spring is a coil spring.

4. The gate assembly of claim 1, wherein said biasing means comprises two parallel generally linear tension springs and an elongate element connected to each said spring, and said return bias inducing means comprises two bend distributing members, each said bend distributing member having a surface of substantial length engaging a respective one of said elongate elements when said gate is near the open position, and said return bias inducing means further comprises at least one supporting member supporting each of said bend distributing members and a gate engaging member extending between said supporting members, said gate contacting said gate engaging member when said gate is in a precisely vertical orientation.

5. The gate assembly of claim 1, wherein said gate is pivotable about a pivot axis adjacent to the bottom of the gate, and said biasing means is connected to said gate at a point adjacent to the bottom of the gate and spaced above the pivot axis.

6. The gate assembly of claim 1, wherein said gate contacting means is stationary.

7. The gate assembly of claim 1, wherein said return bias inducing means comprises a bend distributing member, said bend distributing member having a surface of substantial length engaging said elongate element when said gate is near the open position.

8. The gate assembly of claim 7, wherein said return bias inducing means further comprises at least one member supporting said bend distributing member, and a gate engaging member extending from said supporting member in a direction transverse to the length of said elongate element, said gate contacting said gate engaging member when said gate is in a precisely vertical orientation.

9. The gate assembly of claim 7, wherein said surface of said bend distributing member is a curved surface.

10. The gate assembly of claim 9, wherein said bend distributing member is a sheave.

11. The gate assembly of claim 2, wherein said biasing means comprises a plurality of generally linear tension springs and a plurality of elongate elements.

12. The gate assembly of claim 11, wherein said return bias inducing means deflects said elongate elements when said gate is in the open position.

13. The gate assembly of claim 1, further comprising means for driving said gate between said open position and said closed position.

14. The gate assembly of claim 1, wherein said return bias inducing means comprises an engagement member engaging a portion of said biasing means defining a length when said gate is near the open position, said gate assembly further comprising means for mounting said engagement member for movement with said biasing means generally parallel to the length of said portion when said engagement member engages said portion.

15. The gate assembly of claim 1, wherein said elongate element is spaced from said return bias inducing means when said gate is in the closed position.

16. The gate assembly of claim 15, further comprising means for maintaining said elongate element in alignment with said bend distributing member when said elongate element is out of contact with said bend distributing member.

17. The gate assembly of claim 16, wherein said means for maintaining said elongate element in alignment comprises a sheave having a groove aligned with said elongate element, said elongate element being received in said groove when said elongate element is out of contact with said bend distribution member.

18. The gate assembly of claim 17, wherein said elongate element has a thickness, and said sheave is spaced from said bend distributing member by a distance less than the thickness of said elongate element.

19. The gate assembly of claim 18, wherein said bend distributing member is a sheave.

20. A gate assembly comprising:

a gate;

a support for said gate, said gate being movable relative to said support between a closed position, in which said gate is generally horizontal, and an open position, in which said gate is generally vertical;

means for biasing said gate toward the open position, said biasing means exerting a force on said gate insufficient to independently move said gate to the open position, and means for inducing a return bias in said biasing means when said gate is near the open position, said biasing means engaging said return bias inducing means when said gate is near the open position, said return bias inducing means comprising a bend distributing member having a surface of substantial length engaging said biasing means when said gate is near the open position, said return bias inducing means also comprising means for contacting said gate to support said gate in a precisely vertical orientation when said gate is in the open position.

21. A gate assembly comprising:

a gate;

a support for said gate, said gate being movable relative to said support between a closed position, in which said gate is generally horizontal, and an open position, in which said gate is generally vertical;

means for biasing said gate toward the open position, said biasing means defining a length and exerting a force on said gate insufficient to independently move said gate to the open position; and means for inducing a return bias in said biasing means when said gate is near the open position, said biasing means engaging a portion of said return bias inducing means defining a length when said gate is near the open position, said return bias inducing means comprising an engagement member engaging said biasing means when said gate is near the open position, said gate assembly further comprising means for mounting said engagement member for movement with said biasing means generally parallel to the length of said portion when said engagement member engages said portion, said return bias inducing means also comprising means for contacting said gate to support said gate in a precisely vertical orientation when said gate is in the open position.

* * * * *